US010032587B2

(12) United States Patent
Yang

(10) Patent No.: US 10,032,587 B2
(45) Date of Patent: Jul. 24, 2018

(54) DIRECT CURRENT RELAY

(71) Applicant: LSIS CO., LTD., Gyeonggi-do (KR)

(72) Inventor: Junhyuk Yang, Gyeonggi-do (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/381,636

(22) Filed: Dec. 16, 2016

(65) Prior Publication Data

US 2017/0194121 A1 Jul. 6, 2017

(30) Foreign Application Priority Data

Dec. 30, 2015 (KR) ..... 10-2015-0190348

(51) Int. Cl.
*H01H 50/30* (2006.01)
*H01H 50/18* (2006.01)
(Continued)

(52) U.S. Cl.
CPC ..... *H01H 50/305* (2013.01); *H01H 50/18* (2013.01); *H01H 50/36* (2013.01);
(Continued)

(58) Field of Classification Search
CPC ..... H01H 50/18; H01H 50/36; H01H 50/58; H01H 50/305; H01H 50/54; H01H 51/065;
(Continued)

(56) References Cited

U.S. PATENT DOCUMENTS 8,269,585 B2 * 9/2012 Choi ..... H01H 1/2008 335/126
8,330,565 B2 * 12/2012 Eum ..... H01H 51/065 335/126
(Continued)

FOREIGN PATENT DOCUMENTS

CN 101978453 A 2/2011
CN 102456513 A 5/2012
(Continued)

OTHER PUBLICATIONS

Extended European Search Report for Application No. 16198894.4 dated May 23, 2017 in 6 pages.
(Continued)

*Primary Examiner* — Mohamad Musleh
(74) *Attorney, Agent, or Firm* — K&L Gates LLP

(57) ABSTRACT

In some embodiments, a DC relay includes a pair of fixed contacts fixedly installed on one side of a frame, a movable contact movably installed below the pair of fixed contacts and brought into contact with the pair of fixed contacts or separated therefrom, an insulating plate installed below the movable contact, a contact spring provided between the movable contact and the insulating plate, a plate installed below the insulating plate and including a through hole formed in a central portion thereof, a fixed core inserted from above the plate through the through hole and including a shaft hole formed at the center thereof, an anti-noise pad provided between the fixed core and the insulating plate, a movable core installed to be linearly movable below the fixed core, and a shaft installed to penetrate through the through hole.

4 Claims, 8 Drawing Sheets

(51) Int. Cl.

| | |
|---|---|
| ***H01H 50/36*** | (2006.01) |
| ***H01H 50/54*** | (2006.01) |
| ***H01H 50/58*** | (2006.01) |
| *H01H 3/60* | (2006.01) |
| *H01H 50/22* | (2006.01) |
| *H01H 50/66* | (2006.01) |
| *H01H 51/06* | (2006.01) |

(52) U.S. Cl.
CPC ..... *H01H 50/54* (2013.01); *H01H 50/58* (2013.01); *H01H 3/60* (2013.01); *H01H 50/22* (2013.01); *H01H 50/546* (2013.01); *H01H 50/66* (2013.01); *H01H 51/065* (2013.01)

(58) Field of Classification Search
CPC ..... H01H 50/66; H01H 50/546; H01H 3/60; H01H 50/22
See application file for complete search history.

(56) References Cited

U.S. PATENT DOCUMENTS

| | | | | |
|---|---|---|---|---|
| 8,354,905 | B2 | 1/2013 | Eum | |
| 8,552,823 | B2 | 10/2013 | Lsonaga | |
| 2007/0241847 | A1* | 10/2007 | Yamamoto | H01H 50/305 335/196 |
| 2011/0032059 | A1 | 2/2011 | Ito et al. | |
| 2012/0092101 | A1 | 4/2012 | Eum | |
| 2012/0092102 | A1 | 4/2012 | Eum | |
| 2013/0214881 | A1 | 8/2013 | Ito et al. | |
| 2013/0214884 | A1 | 8/2013 | Ito et al. | |
| 2015/0213982 | A1* | 7/2015 | Lim | H01H 1/54 335/185 |

FOREIGN PATENT DOCUMENTS

| | | | |
|---|---|---|---|
| CN | 103258689 | A | 8/2013 |
| EP | 2267746 | A1 | 12/2010 |
| JP | 2009230919 | A | 10/2009 |
| JP | 2012-028310 | | 2/2012 |
| JP | 2012-199127 | | 10/2012 |
| JP | 2014067676 | A | 4/2014 |
| JP | 2014-238919 | | 12/2014 |
| JP | 2015-130260 | | 7/2015 |
| KR | 10-1072629 | | 10/2011 |
| KR | 10-1072630 | | 10/2011 |
| KR | 10-1075590 | | 10/2011 |
| KR | 10-1251921 | | 4/2013 |
| WO | 2009116493 | A1 | 9/2009 |

OTHER PUBLICATIONS

Search Report from Korean Application 02-6915-6752 dated Oct. 8, 2015 in 3 pages.

Japanese Office Action for related Japanese Application No. 2016-246451; action dated Oct. 24, 2017; (3 pages).

* cited by examiner

DIRECT CURRENT RELAY

CROSS-REFERENCE TO RELATED APPLICATIONS

This application claims the benefit of Korean Application No. 10-2015-0190348, filed on Dec. 30, 2015, which is hereby incorporated by reference in its entirety.

TECHNICAL FIELD

The present disclosure relates to a direct current (DC) relay, and particularly, to a DC relay in which an impact generated between a fixed cord and a movable core during an ON operation is alleviated to reduce noise generation.

BACKGROUND

In general, a DC relay or a magnetic switch, a sort of an electric circuit switchgear transmitting a mechanical driving force and a current signal using a principle of an electromagnet, is installed in various industrial facilities, machines, vehicles, and the like.

In particular, electric vehicles such as hybrid vehicles, fuel cell vehicles, golf carts, and electronic forklifts, and the like have an electric vehicle relay for supplying power of a battery to a power generating device and an electric device part or cutting off power supply thereto, and the electric vehicle relay is one of key components in electric vehicles.

FIGS. 1 and 2 are vertical cross-sectional views of a related art DC relay. FIG. 1 illustrates a breaking state (OFF state) and FIG. 2 is a conducted state (ON state).

A configuration of the related art DC relay includes a fixed contact 2 fixed to and installed on an upper portion of an arc chamber 1, a movable contact 3 installed to be linearly movable within the arc chamber 1 so as to be brought into contact with or separated from the fixed contact 2, an actuator A installed below the arc chamber 1 and linearly operating the movable contact 3, and a contact spring 4 for securing contact force of the movable contact 3.

The actuator A includes a coil 5 generating a magnetic field when external power is input, a fixed core 6 fixed to and installed within the coil 5, a movable core 7 installed to make a linear movement below the fixed core 6, a shaft 8 fixedly coupled to the movable core 7 and slidably coupled to the movable contact 3 in an upper end thereof, and a return spring 9 installed between the fixed core 6 and the movable core 7 and returning the movable core 7 in a direction away from the fixed core 6. Here, the shaft 8 is guided to be slidably movable through a shaft hole formed in a central portion of the fixed core 6.

An operation of the related art DC relay is as follows. First, an ON operation of the related art DC relay is as follows. When a current flows to the coil 5 during a breaking state, a magnetic field is formed around the coil 5 and the fixed core 6 is magnetized in the magnetic field. The movable core 7, compressing the return spring 9, is lifted by a magnetic attractive force of the fixed core 6. In addition, as the shaft 8 coupled to the movable core 7, while compressing the contact spring 4, is lifted to push up the movable contact 3 to contact the fixed contact 2, whereby a main circuit is conducted. That is, the DC relay is conducted.

Here, as the movable core 7 and the fixed core 6 collide, noise is generated.

Thus, emotional quality is degraded due to noise generated as the movable core 7 and the fixed core 6 collide during the ON operation.

SUMMARY

Therefore, an aspect of some embodiments of the disclosure is to provide a direct current (DC) relay in which noise is reduced by alleviating an impact generated between a fixed core and a movable core during an ON operation.

To achieve these and other advantages and in accordance with some embodiments, as embodied and broadly described herein, a DC relay includes: a pair of fixed contacts fixedly installed on one side of a frame; a movable contact movably installed below the pair of fixed contacts and brought into contact with the pair of fixed contacts or separated therefrom; an insulating plate installed below the movable contact 12; a contact spring provided between the movable contact and the insulating plate; a plate installed below the insulating plate 25 and including a through hole formed in a central portion thereof; a fixed core 40 inserted from above the plate 20 through the through hole 21 and including a shaft hole formed at the center thereof; an anti-noise pad provided between the fixed core and the insulating plate; a movable core installed to be linearly movable below the fixed core; and a shaft installed to penetrate through the through hole and including an upper end fixed to the movable contact and a lower end coupled to the movable core.

An upper surface of the fixed core may include a flange portion.

An installation recess allowing the anti-noise pad to be partially inserted therein may be formed below the insulating plate.

A height of the anti-noise pad may be formed to be longer than a depth of the installation recess.

The anti-noise pad may be formed to include an area larger than an upper surface of the fixed core.

A plurality of circumferential recesses may be provided on the upper surface of the fixed core.

The anti-noise pad may cover the flange portion.

According to the DC relay according to some embodiments of the present disclosure, since the fixed core is inserted from above the plate so as to be installed and secures a gap allowing an upward movement, an impact with respect to the movable core may be alleviated during an ON operation, reducing noise.

Further scope of applicability of the present disclosure will become more apparent from the detailed description given hereinafter. However, it should be understood that the detailed description and specific examples, while indicating embodiments of the disclosure, are given by way of illustration only, since various changes and modifications within the scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate embodiments and together with the description serve to explain the principles of the disclosure.

In the drawings:

FIGS. 1 and 2 are views illustrating a structure of a DC relay according to the prior art, in which FIG. 1 illustrates an OFF state and FIG. 2 illustrates an ON state.

FIGS. 3 and 4 are views illustrating a structure of a DC relay according to some embodiments of the present disclosure, in which FIG. 3 illustrates an OFF state and FIG. 4 illustrates an ON state.

DETAILED DESCRIPTION

Hereinafter, embodiments of a manual charging apparatus of a vacuum interrupter in accordance with some embodiments of the present disclosure will now be described in detail with reference to the accompanying drawings.

Figure 1:
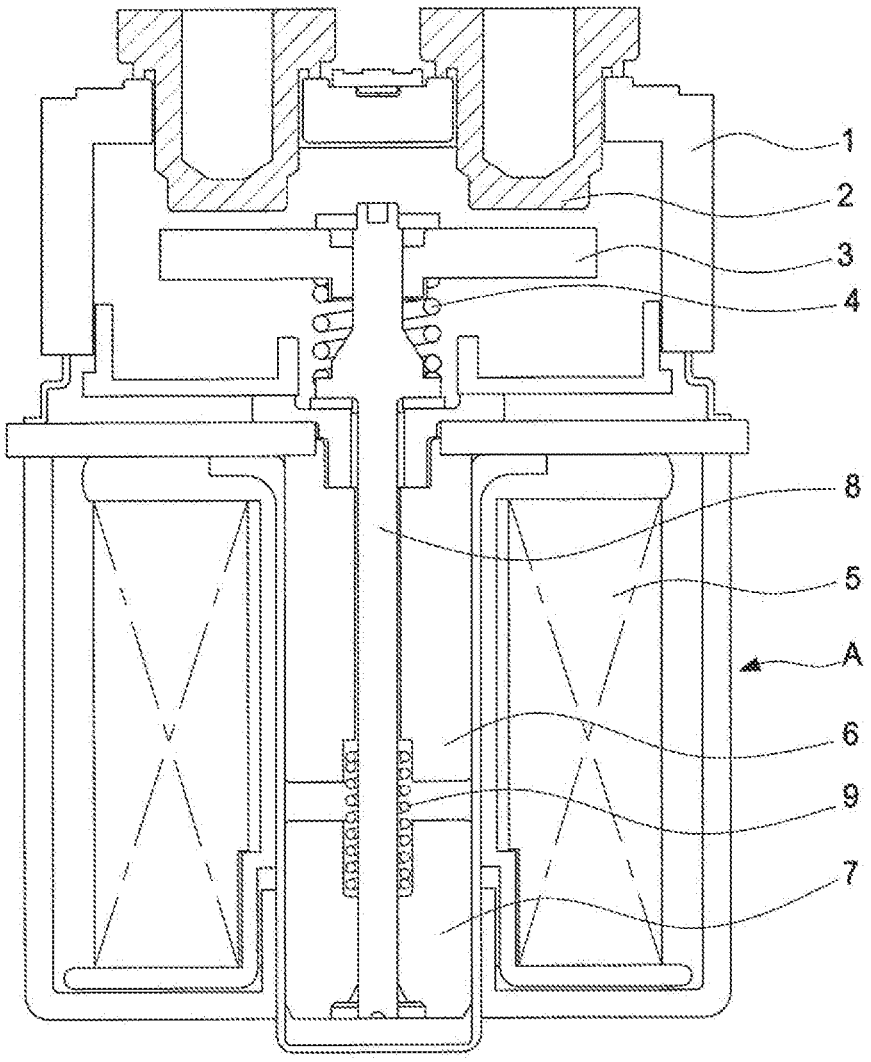
Fig. 1 Prior Art
Figure 2:
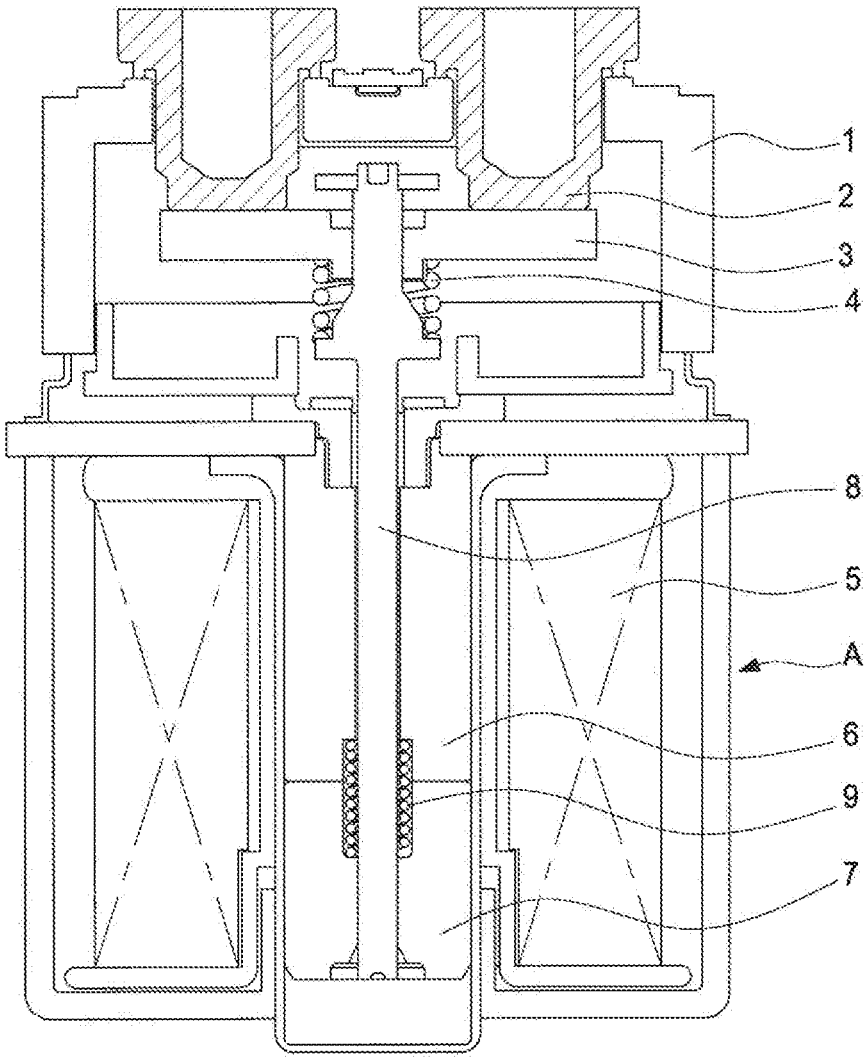
Fig. 2 Prior Art
Figure 3:
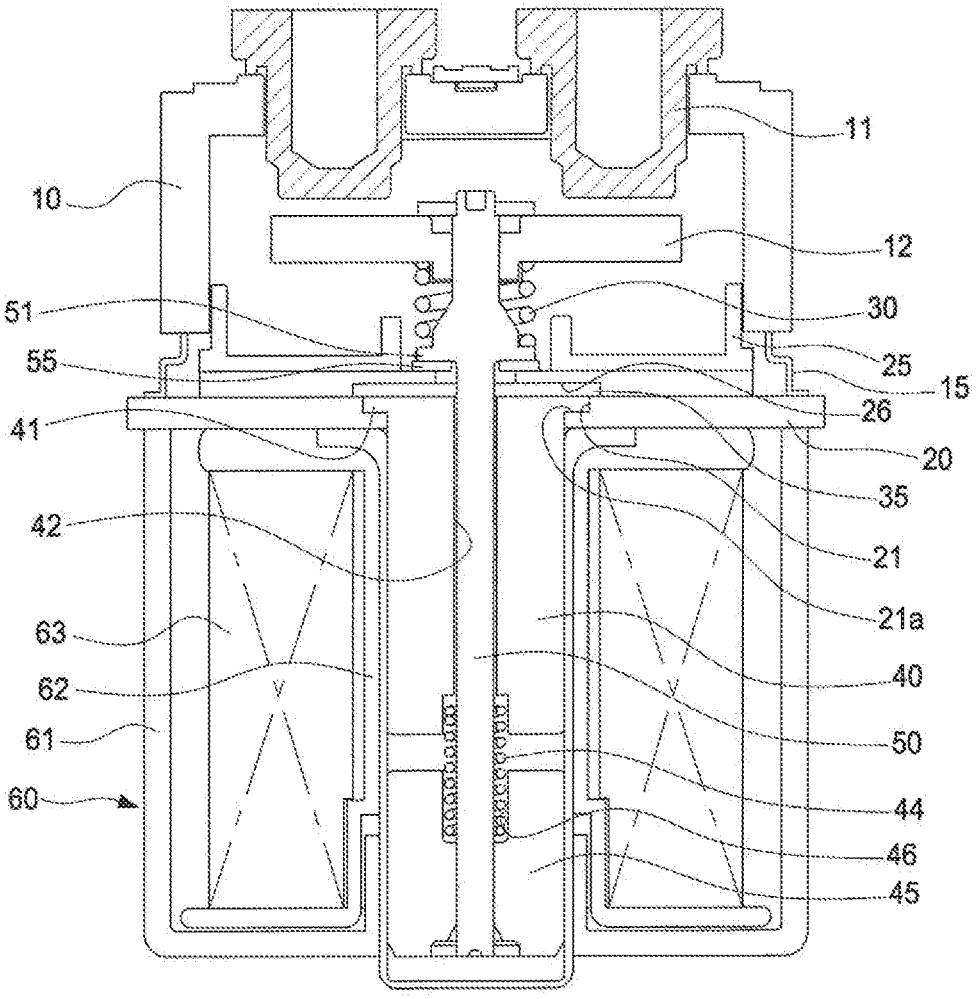
Figure 4:
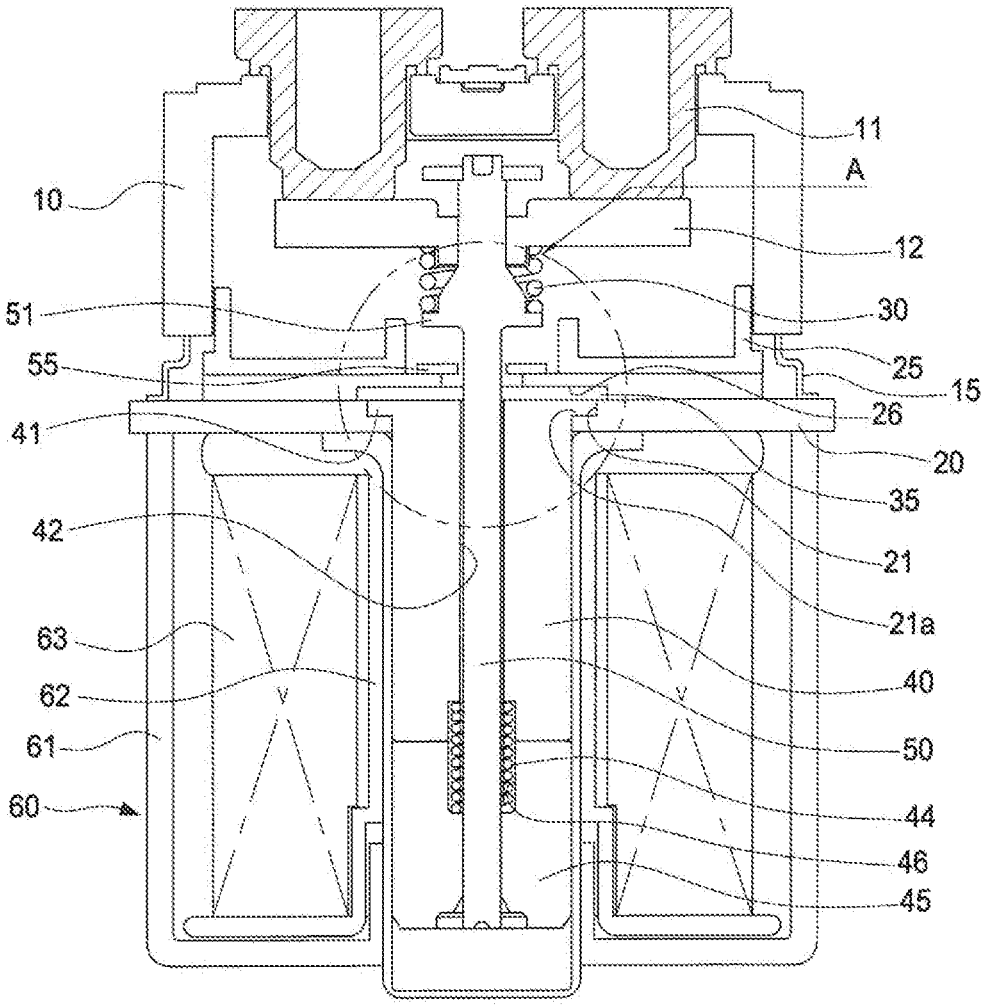

FIGS. 3 and 4 are views illustrating a structure of a DC relay according to some embodiments of the present disclosure, in which FIG. 3 illustrates an OFF state and FIG. 4 illustrates an ON state. Hereinafter, a relay according to embodiments of the present disclosure will be described in detail with reference to the accompanying drawings.

A DC relay according to some embodiments of the present disclosure includes a pair of fixed contacts 11 installed on one side of a frame; a movable contact 12 installed to be linearly movable below the pair of fixed contacts 11 and brought into contact with the pair of fixed contacts 11 or separated therefrom; an insulating plate 25 installed below the movable contact 12; a contact spring 30 provided between the movable contact 12 and the insulating plate 25; a plate 20 installed below the insulating plate 25 and including a though hole 21 formed in a central portion thereof; a fixed core 40 inserted from an upper portion of the plate 20 through the through hole 21 so as to be installed and including a shaft hole 42 formed at the center thereof; an anti-noise pad 35 provided between the fixed core 40 and the insulating plate 25; a movable core 45 installed to be linearly movable below the fixed core 40; and a shaft 50 installed to penetrate through the through hole 21 and including an upper end fixed to the movable contact 12 and a lower end coupled to the movable core 45.

Although not shown, the frame may be formed as a box-shaped case in which the components illustrated in FIG. 3 are installed and supported. The frame may include an upper frame and a lower frame.

The arc chamber 10 includes a box shape with an open lower side and is installed on an upper side within the DC relay. The arc chamber 10 is formed of a material including excellent insulating properties, pressure resisting quality, and heat resistance to be able to extinguish an arc generated in a contact part when a breaking operation is performed.

The fixed contact 11 is provide das a pair and fixedly installed in the frame (not shown) and the arc chamber 10. Among the pair of fixed contacts 11, any one may be connected to a power source side and the other may be connected to a load side.

The movable contact 12 includes a plate shape with a predetermined length, and is installed below the pair of fixed contacts 11. The movable contact 12 may be linearly moved up and down by the actuator 60 installed on a lower side within the relay and may be brought into contact with or separated from the fixed contact 11.

The actuator 60 may include a yoke 61 including a U shape and forming a magnetic circuit, a coil 63 wound around a bobbin 62 installed within the yoke 61 and generating a magnetic field upon receiving external power, a fixed core 40 fixedly installed within the coil 63 and magnetized by a magnetic field generated by the coil 63 to generate magnetic attractive force, a movable core 40 installed to be linearly movable below the fixed core 40 and brought into contact with the fixed core 40 or separated from the fixed core 40 by a magnetic attractive force of the fixed core 40, a shaft 50 coupled to the movable core 45 in a lower end thereof and slidably penetrating through and inserted into the movable contact 12 in an upper end thereof; and a return spring 44 installed between the fixed core 40 and the movable core 45 and returning the movable core 45 downwardly.

A plate 20 is provided between the actuator 60 and the arc chamber 10. The plate 20 may be coupled to an upper portion of the yoke 61. The plate 20 may be formed of a magnetic substance to form a magnetic path and may also serve as a support plate on which the arc chamber 10 and the lower actuator 60 may be installed.

A sealing member may be provided between the plate 20 and the arc chamber 10. That is, a sealing cover member 15 may be provided along a lower circumference of the arc chamber 10.

The contact spring 30 is provided between the movable contact 12 and the plate 20. The contact spring 30 is provided to support the movable contact 12 and provide contact force to the movable contact 12 at the time of conduction. The contact spring 30 may be configured as a compression coil spring.

An insulating plate 25 may be provided between the arc chamber 10 and the plate 20 in order to guarantee insulating performance. The insulating plate 25 may cover a lower surface of the arc chamber 25 and may be installed to be spaced apart from the plate 20 at a predetermined distance. When the insulating plate 25 is provided, the contact spring 30 may be installed between the insulating plate 25 and the movable contact 12. An installation recess 26 may be formed under the insulating plate 25 to allow an anti-noise pad 35 to be inserted therein. The anti-noise pad 35 may be installed into the installation recess 26 to alleviate an impact of the fixed core 40.

The fixed core 40 may be installed in a manner of being inserted into the plate 20 from above. In the related art, the fixed core is installed to a lower portion of the plate through welding, or the like, and thus, when an impact occurs with respect to the movable core, noise is generated. Thus, in order to reduce this, the fixed core 40 is installed in an insertion manner in a upper portion of the plate 20 so as to be moved upwardly.

In some embodiments enabling the fixed core 40 to move, a protrusion portion 21*a* is provided in the through hole 21 of the plate 20, and a flange portion 41 which may be mounted on the protrusion portion 21*a* is formed in an upper portion of the fixed core 40, so that the flange portion 41 is installed to be mounted on the protrusion portion 21*a*. That is, the fixed core 40 may be movably mounted on an upper portion of the plate 20. Accordingly, when an impact is applied due to the movable core 45, the fixed core 40 may be slightly moved upwardly, reducing the impact and noise.

Unlike the related art in which the fixed core 40 is welded to a lower portion of the plate 20, the fixed core 40 is installed to be movable upwardly, and thus, an impact that may be generated during an ON operation may be reduced.

Figure 5:
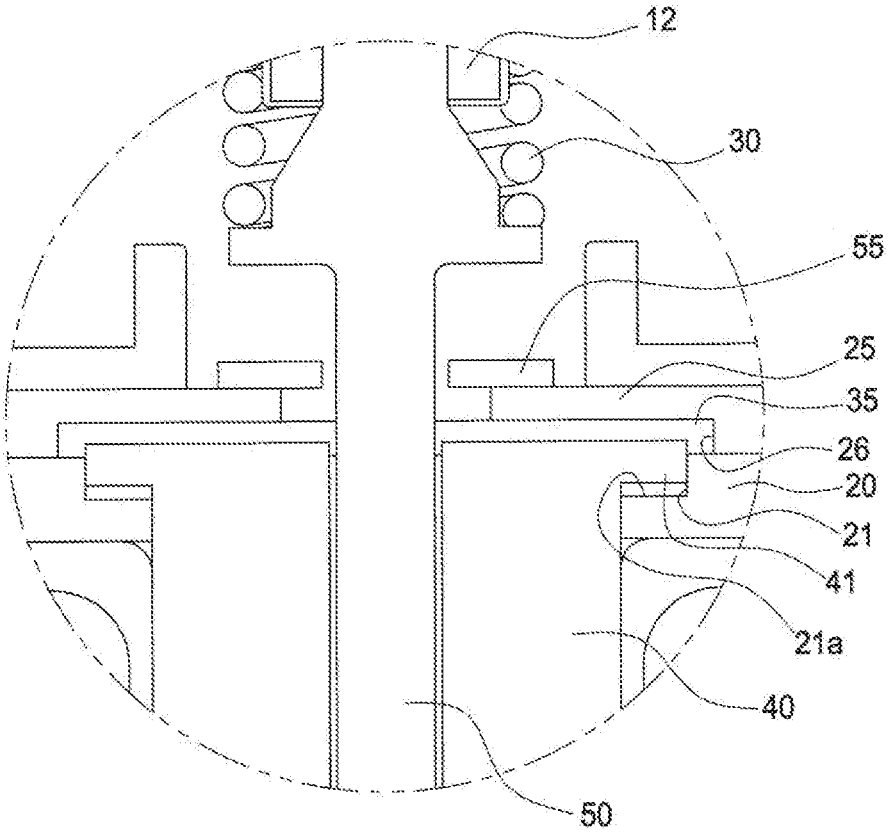
FIG. 5 is a partially detailed view of FIG. 4, according to some embodiments of the present disclosure.

The anti-noise pad 35 is provided between the insulating plate 25 and the plate 20 in order to reduce noise generated between the fixed core 40 and the movable core 45 during an ON operation. The anti-noise pad 35 may be installed in an upper portion of the plate 20. Since the anti-noise pad 35 is provided on the fixed core 40, when the fixed core 40 moves upwardly, impact is absorbed by the anti-noise pad 35, reducing noise. With reference to FIG. 5, a state in which, during an ON operation, the fixed core 40 is slightly separated from the plate 20 to compress the anti-noise pad 35.

The anti-noise pad 35 may be formed of a material such as rubber, a soft synthetic resin, and the like. The anti-noise pad 35 may be formed of a material appropriate for absorbing noise or an impact.

Also, the anti-noise pad 35 may be inserted and installed in the installation recess 26 of the insulating plate 25. Here, a height of the anti-noise pad 35 may be formed to be longer (greater) than a depth of the installation recess 26. Thus, the anti-noise pad 35 may be installed in a compressed manner between the insulating plate 25 and the fixed core 40 to stably press the fixed core 40.

Also, a width (diameter) of the anti-noise pad 35 may be formed to be larger (greater) than a width (diameter) of the flange portion 41 of the fixed core 40. Thus, an impact of the fixed core 40 may be entirely absorbed.

The shaft 50 is installed to penetrate through the through hole 21, and an upper end thereof is fixed to the movable contact 12. A lower end portion of the shaft 50 is fixedly coupled to the movable core 45 and moved together according to movement of the movable core 45. The shaft 50 is slidably inserted through the fixed core 40, the anti-noise pad 35, and the insulating plate 25 so as to be installed and fixed to the movable contact 12. A protrusion portion 51 is formed in a portion of the shaft 50 and the contact spring 30 is installed thereon.

An elastic member 55 may be provided under the protrusion portion 51. An impact at the time of an OFF operation may be absorbed by the elastic member.

In order to help the movable core 45 return, the return spring 44 is provided. The return spring 44 may be configured as a compression coil spring. A lower end of the return spring 44 may be fixed to a spring recess formed in an upper portion of the movable core 45, and an upper end of the return spring 44 may be fixed to a spring recess (not shown0 formed in a lower portion of the fixed core 40. In some embodiments of installation of the return spring 44, the return spring 44 may be installed to penetrate through the shaft hole 42 of the fixed core 40 such that an upper end thereof is fixed to the anti-noise pad 35.

Here, a spring constant of the return spring 44 may be set to be greater than a spring constant of the contact spring 30. Thus, at the time of an OFF operation, the shaft 50 may be lowered rapidly due to a restoring force of the return spring 44.

An operation of the DC relay according to some embodiments of the present disclosure will be described.

First, an ON operation will be briefly described with reference to FIGS. 3 and 4. When external power is input in an OFF state as illustrated in FIG. 3, a magnetic field is generated around the coil 63 and the fixed core 40 is magnetized. The movable core 45 is attracted to collide with the fixed core 40 by a magnetic attractive force. Here, an impact generated as the movable core 45 is brought into contact with the fixed core 40 is partially absorbed in a process in which the fixed core 40 is lifted by a predetermined distance, while compressing the anti-noise pad 35, so as to be reduced, and thus, noise is also reduced (please refer to FIG. 5).

Figure 6:
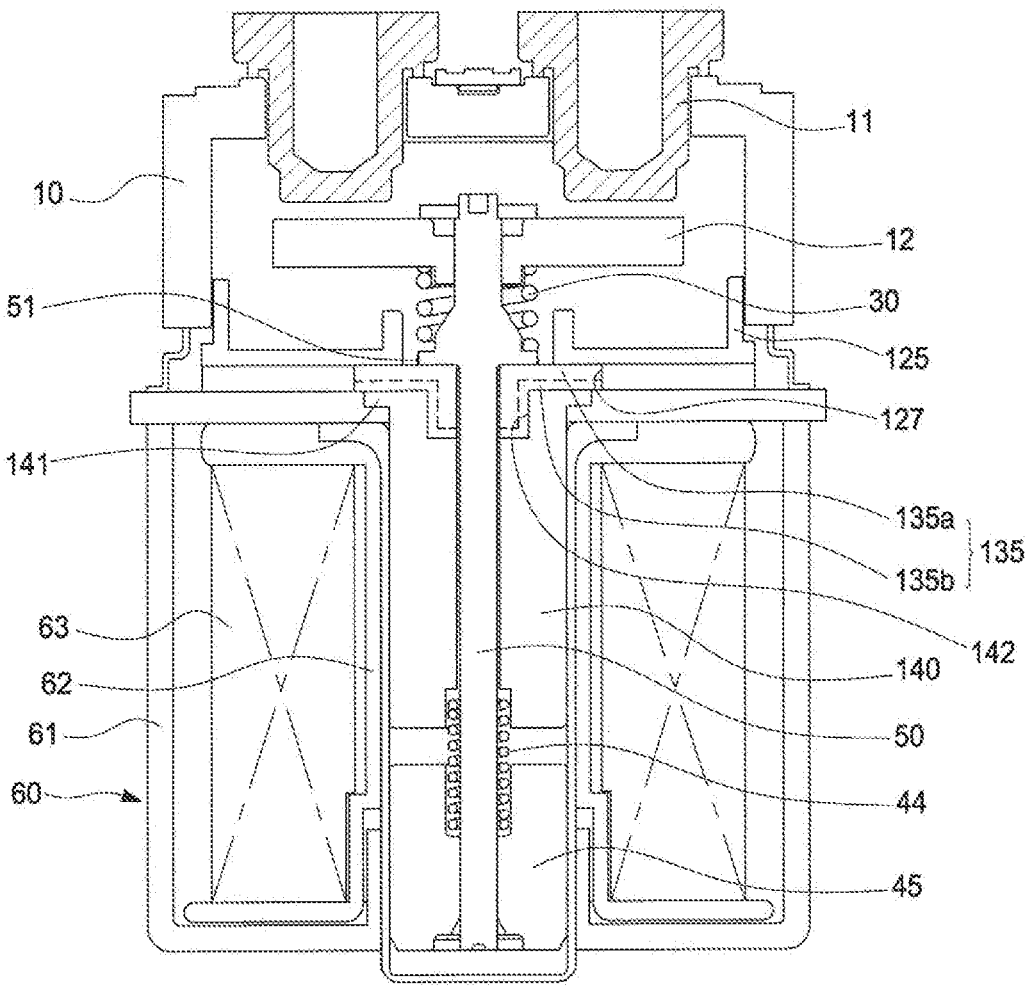
FIGS. 6 to 8 are partial cross-sectional views of a DC relay according to some embodiments of the present disclosure.

FIG. 6 illustrates a DC relay according to some embodiments of the present disclosure. In some embodiments, a step hole 127 is formed at a central portion of the insulating plate 25. The protrusion portion 51 of the shaft 50 is placed in an upper portion of the step hole 127. An anti-noise pad 135 is installed within the step hole 127.

The anti-noise pad 135 includes a flange shape and the protrusion portion 51 of the shaft 50 is placed on an upper surface of the anti-noise pad 135 and a lower surface of the anti-noise pad 135 is in contact with an upper surface of the fixed core 140. Meanwhile, the anti-noise pad 135 may be formed of dual materials. That is, an upper portion 135*a* of the anti-noise pad 135 may be formed of hard rubber and a lower portion 135*b* of the anti-noise pad 135 may be formed of soft rubber. In this manner, the anti-noise pad 135 may include both rigidity and elasticity.

A flange portion 141 may be formed on an upper portion of the fixed core 140, and an insertion recess 142 may be formed in an upper central portion of the fixed core 140 to allow a portion of the anti-noise pad 135 to be insertedly installed therein.

Figure 7:
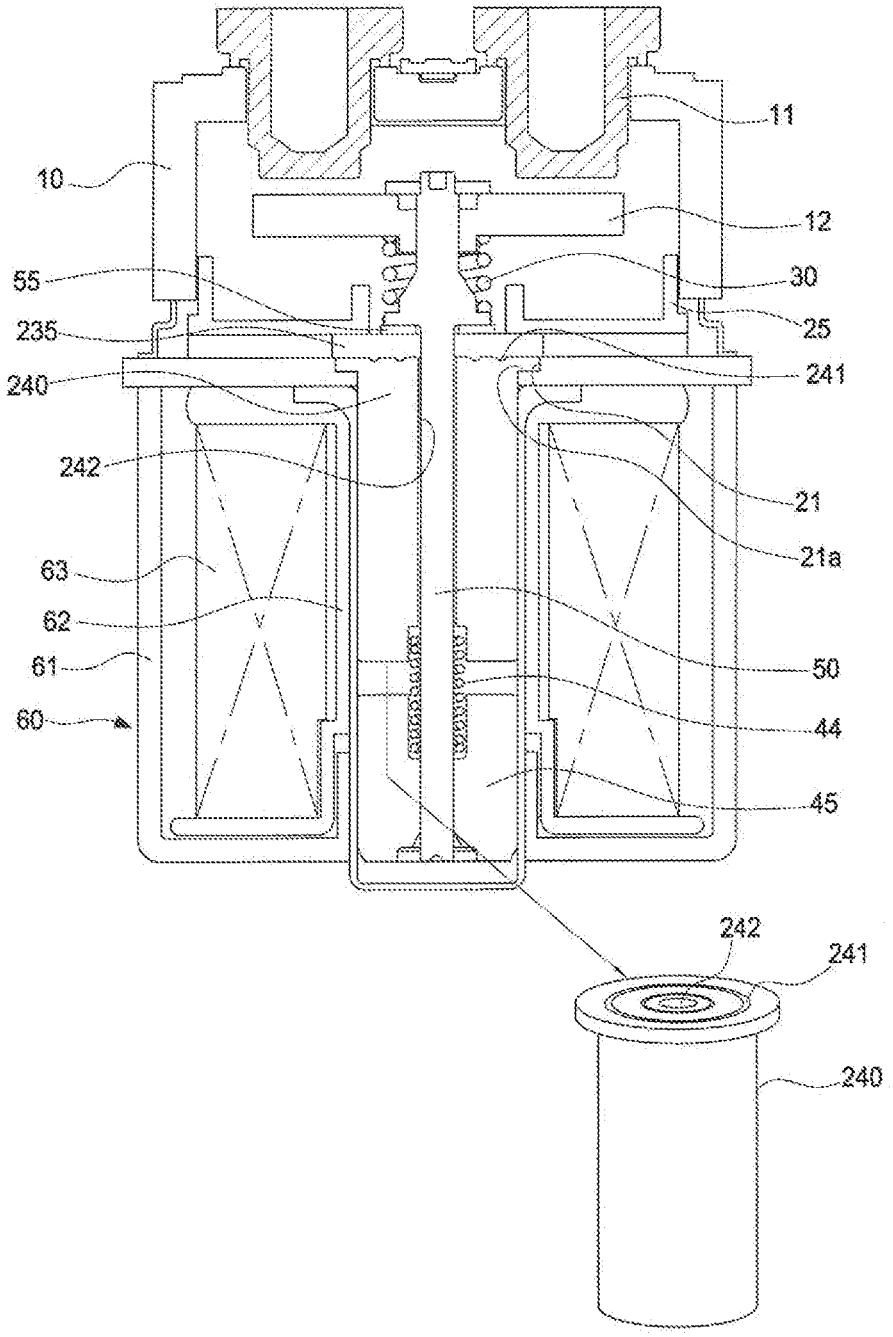

FIG. 7 illustrates a DC relay according to some embodiments of the present disclosure. In some embodiments, a plurality of circumferential grooves 241 in such a form of annual rings are formed on an upper surface of the fixed core 240. Thus, the area of the upper surface of the fixed core 240 is increased. Thus, a contact area with the anti-noise pad 235 is increased to advantageously absorb noise. Here, reference numeral 242 is a shaft hole.

Figure 8:
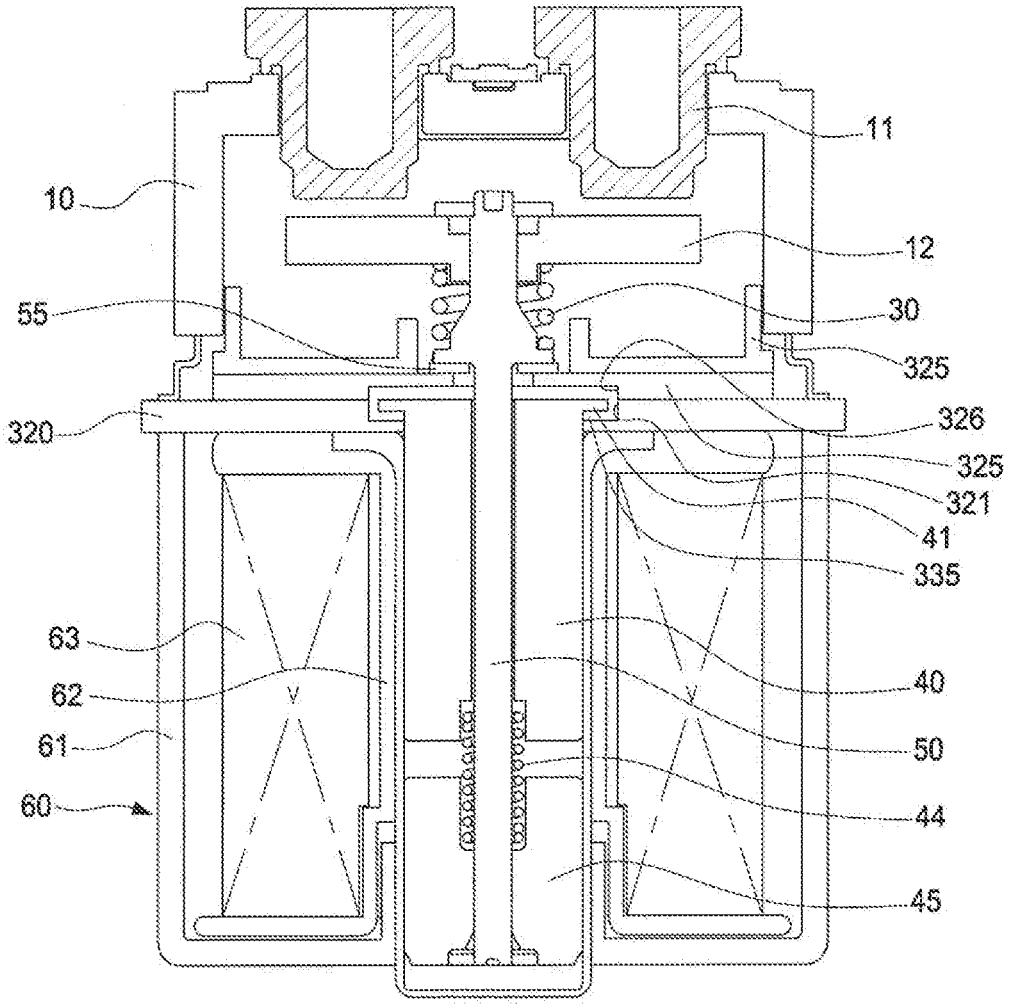

FIG. 8 illustrates a DC relay according to some embodiments of the present disclosure. In some embodiments, a diameter of an installation recess 326 of an insulating plate 325 and a diameter of a through hole 321 of a plate 320 may be equal. Also, an anti-noise pad 335 may be provided in a form of covering the flange portion 41 of the fixed core 40. Thus, impact absorption and vibration absorption may be facilitated.

As described above, according to some embodiments of the present disclosure, since the fixed core is inserted from above the plate so as to be installed and secures a gap allowing an upward movement, an impact with respect to the movable core may be alleviated during an ON operation, reducing noise.

The foregoing embodiments and advantages are merely and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the embodiments described herein may be combined in various ways to obtain additional and/or alternative embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims. The features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A DC relay comprising:

a pair of fixed contacts fixedly disposed on one side of a frame;

a movable contact movably disposed below the pair of fixed contacts and configured to be brought into contact with the pair of fixed contacts or separated therefrom;

an insulating plate disposed below the movable contact;

a contact spring disposed between the movable contact and the insulating plate;

a plate disposed below the insulating plate and including a through hole formed in a central portion thereof;

a fixed core inserted from above the plate through the through hole and including a shaft hole disposed at the center thereof;

an anti-noise pad disposed between the fixed core and the insulating plate;

a movable core configured to be linearly movable below the fixed core; and a shaft configured to penetrate through the through hole and including an upper end fixed to the movable contact and a lower end coupled to the movable core, wherein an installation recess allowing the anti-noise pad to be partially inserted therein is formed below the insulating plate, wherein a height of the anti-noise pad is formed to be longer than a depth of the installation recess, wherein the anti-noise pad is formed to have an area larger than an upper surface of the fixed core, and wherein the anti-noise pad is formed of dual materials, an upper portion of the anti-noise pad is formed of hard rubber and a lower portion of the anti-noise pad is formed of soft rubber.

2. The DC relay of claim 1, wherein an upper surface of the fixed core includes a flange portion.

3. The DC relay of claim 1, wherein a plurality of circumferential recesses are disposed on the upper surface of the fixed core.

4. The DC relay of claim 2, wherein the anti-noise pad covers the flange portion.

* * * * *